US006330912B1

(12) United States Patent
Gillis et al.

(10) Patent No.: US 6,330,912 B1
(45) Date of Patent: Dec. 18, 2001

(54) PACK-OFF BUSHING

(75) Inventors: Ian Gillis; Craig Knull, both of Leduc (CA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 09/497,872

(22) Filed: Feb. 4, 2000

(30) Foreign Application Priority Data

Dec. 23, 1999 (CA) ..... 2293095

(51) Int. Cl.[7] ..... E21B 33/13
(52) U.S. Cl. ..... 166/177.4; 166/242.1
(58) Field of Search ..... 166/177.4, 242.1; 175/321

(56) References Cited

U.S. PATENT DOCUMENTS

| | | | | |
|---|---|---|---|---|
| 3,088,532 | * | 5/1963 | Kellner | 175/321 |
| 3,225,843 | * | 12/1965 | Ortloff et al. | 175/321 |
| 3,608,634 | | 9/1971 | Cochran . | |
| 3,815,692 | * | 6/1974 | Varley | 175/65 |
| 4,372,393 | | 2/1983 | Baker . | |
| 4,690,220 | | 9/1987 | Braddick . | |
| 4,966,236 | | 10/1990 | Braddick . | |
| 5,411,099 | | 5/1995 | Braddick . | |
| 5,472,055 | | 12/1995 | Simson et al. . | |
| 5,857,524 | | 1/1999 | Harris et al. . | |
| 5,918,673 | * | 7/1999 | Hawkins et al. | 166/285 |
| 5,918,674 | * | 7/1999 | Head | 166/348 |
| B1 3,920,075 | | 2/1985 | Braddick et al. . | |
| B1 4,281,711 | | 2/1985 | Braddick et al. . | |

FOREIGN PATENT DOCUMENTS

2219327 A 12/1989 (GB) .

OTHER PUBLICATIONS

Liner Equipment Brochure, p. 10 entitled "Packoff Bushings and Swab Assemblies" by Texas Iron Works, Inc. of Houston, Texas, USA (undated).

Petroleum Industry Training Service, Drilling Engineering vol. 2, Chapter 6 "Cement and Cementation Techniques" (1995) pp. 6–40 to 6–56.

UK Search Report Apr. 20, 2001.

* cited by examiner

*Primary Examiner*—Hoang Dang
(74) *Attorney, Agent, or Firm*—Terrence N. Kuharchuk; William Schull; Michael D. McCully

(57) ABSTRACT

A pack-off bushing for placement inside an outer conduit while a fluid is passed through an inner conduit positioned within the outer conduit. The bushing includes a mandrel having a mandrel passage extending axially therethrough, a housing carried on the mandrel and capable of axial movement relative to the mandrel and a balancing system associated with the mandrel and the housing for applying a balancing force to the mandrel to oppose an axial mandrel force applied to the mandrel.

24 Claims, 2 Drawing Sheets

PACK-OFF BUSHING

TECHNICAL FIELD

A pack-off bushing for placement in an outer conduit while a fluid is passed through an inner conduit positioned within the outer conduit.

BACKGROUND OF THE INVENTION

Many situations arise in which it is necessary or desirable to deliver a fluid through an outer conduit via an inner conduit positioned in the outer conduit. Such situations commonly arise in the drilling or completion of boreholes or in the production of fluids from boreholes.

In particular, it is customary to line boreholes with a liner conduit in order to provide structural integrity to the borehole and to facilitate the carrying out of subsequent operations in the borehole. Often these liner conduits are comprised of a casing string, a liner or both.

Typically liner conduits are positioned and then permanently fixed in the borehole using cement or some other bonding material which is placed in the annular space between the liner conduit and the borehole wall. This bonding material is usually delivered to the bottom of the liner conduit and then forced under pressure into the annular space between the liner conduit and the borehole wall where it is permitted to set and form a bond between the liner conduit and the borehole.

The challenge in these "bonding" or "cementing" operations is to deliver the bonding material to the annular space surrounding the liner conduit without permitting the bonding material to move significantly into the interior of the liner conduit itself.

As a result, cementing operations in boreholes are typically carried out using a cementing apparatus which is comprised of an inner conduit which is temporarily placed inside the liner conduit. Fluids such as flushing agents and the bonding material are then passed down the borehole through the inner conduit and released adjacent to the lower end of the liner conduit. In order to prevent these fluids from circulating back up through the liner conduit, it is customary to include a bushing device as part of the cementing apparatus to inhibit the passage of fluids through the interior of the liner conduit after the fluids are released from the inner conduit by providing a full or partial seal between the liner conduit and the inner conduit.

Several challenges are faced in the design and operation of these bushing devices. First, the bushing is exposed to fluid pressure during cementing operations from the fluid which is passed down through the inner conduit and released into the liner conduit. This fluid pressure is significant, tends to push the bushing and/or the inner conduit upwards through the interior of the liner conduit and must be counteracted in some manner, usually by anchoring the bushing in the liner conduit.

Second, since the bushing is intended to provide a seal between the liner conduit and the inner conduit, it occupies a significant amount of space inside the liner conduit. It is therefore desirable that the bushing be removable from the liner conduit in whole or in part after cementing operations are completed in order to minimize the amount of permanent obstruction in the liner conduit caused by the bushing.

Cementing operations may be carried out independently of the task of positioning the liner conduit in the borehole. In situations, however where the liner conduit is an extension of a previously installed liner conduit, cementing operations are often carried out in conjunction with the task of positioning and hanging the liner conduit in order to avoid multiple trips into the borehole and in order to save costs.

As a result, cementing apparatus are often included as a component of liner hanging apparatus, and must therefore often be designed to be compatible with the operational requirements of such liner hanging apparatus. Specifically, the liner hanging apparatus typically includes the inner conduit, which must be manipulated rotationally and/or axially during hanging of the liner. This requirement adds a further challenge to the design of the bushing in that the bushing must accommodate this manipulation, leaving the inner conduit potentially vulnerable during cementing operations to forces exerted by the fluid which tend to push the inner conduit upward in the liner conduit.

The prior art describes several attempts at designing cement bushings or packers for use in association with liner hanging apparatus which can be anchored in the liner conduit and then removed from the liner after use along with the liner hanging apparatus.

U.S. Pat. No. B1 3,920,075 (Braddick et al) and U.S. Pat. No. B1 4,281,711 (Braddick et al) both describe a method and apparatus for bonding a liner conduit in a wellbore which include or utilize a retrievable seal bushing. The seal bushing is releasably locked to the liner conduit and the liner conduit is releasably engaged with an inner conduit described as a well string. The liner conduit and the well string are lowered into the wellbore and the liner conduit is positioned at the desired location in the wellbore. The liner conduit is then disengaged from the well string by rotation of the well string relative to the liner conduit. Bonding operations are carried out by passing a bonding agent through the well string, after which the seal bushing is unlocked from the liner conduit by longitudinal movement of the well string relative to the bushing. Finally, the well string and the seal bushing are retrieved from the wellbore.

Braddick et al rely upon a relatively rugged collar on the well string both to support the well string against upward axial forces exerted on the well string by the fluid and to provide a shoulder which engages the seal bushing upon upward longitudinal movement of the well string to unlock the seal bushing by shearing a shear pin associated with the seal bushing. Braddick et al do not otherwise address the upward axial force which is exerted on the well string, other than to acknowledge that this force is undesirable due to the effect it has on the well string. In particular, Braddick et al do not disclose, teach or suggest how this upward axial force might be reduced or minimized.

U.S. Pat. No. 5,857,524 (Harris et al) describes a liner hanging, sealing and cementing tool including two different embodiments of cement bushing. It is expressed in Harris et al that a main purpose of the cement bushing is to hold the inner conduit (described as a drill pipe) in the liner conduit against the high upward force occurring during pumping of cement through the drill pipe. This purpose is addressed in Harris et al by providing an arrangement of slips or pistons associated with the drill pipe which are actuated by fluid pressure to engage the inner surface of the liner conduit and thus hold the drill pipe in place in the liner conduit. Harris et al does not disclose, teach or suggest how this upward force might be reduced or minimized.

Texas Iron Works, Inc. of Houston, Tex, manufactures a retrievable pack-off bushing based upon the Braddick et al patents discussed above. In advertising material relating to this pack-off bushing it is mentioned that the effects of the upward axial force acting on the inner conduit and the bushing can be reduced by minimizing the cross-sectional area of that portion of the inner conduit which is exposed to fluid pressure during cementing operations.

None of the prior art references outlined above fully address the effects of the upward axial force that is typically exerted on the inner conduit during cementing operations.

There therefore remains a need for a cement bushing which is designed to reduce the magnitude of the upward axial force exerted on the inner conduit during cementing operations. There is also a need for such a cement bushing that may be used in conjunction with liner hanging apparatus. Finally, there is a need for such a cement bushing which is retrievable from the liner conduit after cementing operations are complete.

SUMMARY OF THE INVENTION

The present invention relates to an apparatus for placement inside an outer conduit in situations where a fluid is to be passed through an inner conduit which is positioned within the outer conduit, which apparatus includes a balancing system for providing a balancing force to oppose an axial force applied to the apparatus.

Preferably, the apparatus provides a sealing function to inhibit a fluid which is passed through and released from the inner conduit from moving past the apparatus in the space formed between the outer conduit and the inner conduit. Such apparatus are sometimes referred to in the art as "pack-off bushings" or "seal bushings", or in situations where such apparatus are used to assist in bonding or cementing of the outer conduit in a borehole, they are sometimes referred to as "cement bushings".

Preferably the bushing permits an amount of relative axial movement between the outer conduit and the inner conduit when the bushing is in position inside the outer conduit in order to facilitate axial manipulation of the inner conduit during hanging of the outer conduit and during cementing operations. As a result, preferably the bushing is also adapted to reduce a tendency of the inner conduit to move axially relative to the outer conduit due to an axial force exerted on the inner conduit by the fluid which is passed through and released from the inner conduit. The bushing may also permit an amount of relative rotational movement between the outer conduit and the inner conduit in order to facilitate rotational manipulation of the inner conduit during hanging of the outer conduit and during cementing operations.

Preferably the bushing is also provided with an anchoring device for anchoring the bushing in the outer conduit, thus opposing an axial force exerted on the bushing by the fluid which is passed through and released from the inner conduit. This anchoring device is preferably releasable in order to facilitate removal of the bushing from the outer conduit.

In one aspect, the invention is a pack-off bushing for placement inside an outer conduit while a fluid is passed through an inner conduit positioned within the outer conduit, the bushing comprising:

(a) a mandrel for connection with the inner conduit, the mandrel having a first mandrel end, a second mandrel end, and defining a mandrel passage axially therethrough for conducting the fluid through the mandrel;

(b) a housing carried on the mandrel between the first mandrel end and the second mandrel end, wherein the housing and the mandrel are capable of an amount of relative axial movement; and (c) a balancing system associated with the mandrel and the housing for applying a balancing force to the mandrel to oppose an axial mandrel force applied to the mandrel.

The primary function of the mandrel is to provide the mandrel passage for conducting the fluid. The mandrel also preferably provides other functions. First, the mandrel preferably helps to facilitate sealing between the outer conduit and the inner conduit. Second, the mandrel preferably helps to facilitate the amount of relative axial movement between the mandrel and the housing. Third, the mandrel preferably facilitates the operation of the balancing system. The mandrel may be comprised of any apparatus, structure or device which can perform one or more of these functions.

The housing preferably provides several functions. First, the housing preferably helps to facilitate sealing between the outer conduit and the inner conduit. Second, the housing preferably facilitates anchoring of the bushing in the outer conduit. Third, the housing preferably helps to facilitate the amount of relative axial movement between the housing and the mandrel. Fourth, the housing preferably contains one or more components of the balancing system. The housing may be comprised of any apparatus, structure or device which can perform one or more of these functions.

Preferably the bushing is comprised of a sealing device for providing a seal between the outer conduit and the inner conduit so that the fluid which is passed through and released from the inner conduit is inhibited from moving past the bushing in the outer conduit. This seal may be provided in any manner using any structure, apparatus or device.

Preferably however the outer conduit is comprised of an internal outer conduit surface, the housing is comprised of an outer housing surface, and the seal is comprised of an outer seal assembly for sealing between the internal outer conduit surface and the outer housing surface. In addition, preferably the housing is comprised of an inner housing surface, the mandrel is comprised of an outer mandrel surface, and the seal is further comprised of an inner seal assembly for sealing between the inner housing surface and the outer mandrel surface.

Preferably the bushing is further comprised of an anchoring device for anchoring the bushing in the outer conduit. The anchoring device may be comprised of any apparatus, structure or device which will provide the anchoring function on either a permanent or temporary basis.

Preferably, the anchoring device is a releasable anchoring device in order to facilitate removal of the bushing from the outer conduit. Any apparatus, structure or device capable of providing a releasable anchoring function may be used in the invention. For example, the anchoring device may be designed to be released by axial movement of the bushing, rotation of the bushing, or by some combination of axial movement and rotational movement. An exemplary structure is comprised of at least one key on the housing for engagement with at least one latch on the internal outer conduit surface.

Preferably the anchoring device is released by relative axial movement between the mandrel and the housing and preferably the releasable anchoring device is comprised of at least one key on the housing for engagement with at least one latch on the internal outer conduit surface. In the preferred embodiment the anchoring device is comprised of a plurality of keys which engage a single latch which is comprised of a circumferential groove on the internal outer conduit surface.

Furthermore, in the preferred embodiment the keys are maintained in engagement with the latch by abutment with the outer mandrel surface and are released from the latch by axial movement of the mandrel relative to the housing, which relative axial movement brings a contracted section of the mandrel or the inner conduit into position adjacent to the keys. Alternatively the keys may be maintained in engagement with the latch or latches by a biasing means or by a contoured or expanded section of the mandrel and may be released by rotation of the mandrel, axial movement of the mandrel relative to the housing, or by a combination of these movements.

The balancing system is designed to provide a balancing force to oppose an axial mandrel force applied to the mandrel so that the balancing force provides a resistance to axial movement of the mandrel relative to the housing as a result of the axial mandrel force.

The mandrel may be subjected to a variety of different axial mandrel forces from different sources and the balancing system may be designed to oppose any such axial mandrel forces. In the preferred embodiment the axial mandrel force results primarily from a fluid pressure exerted by the fluid which is passed through and is released from the inner conduit into the outer conduit, which fluid pressure acts on the mandrel to apply the axial mandrel force to the mandrel.

The balancing system may be comprised of any apparatus, structure or device which is capable of providing the balancing force to the mandrel to oppose the axial mandrel force. The balancing force may be constant or varying and may be preset to a desired level to anticipate the magnitudes of the axial mandrel forces likely to be applied to the mandrel. The balancing force may be applied to the mandrel either directly or indirectly and may be applied in any manner, such as for example by a biasing device such as a spring system or a compressible fluid or with a pressurized fluid.

The balancing system is preferably comprised of a balancing chamber defined between the housing and the mandrel so that the balancing force is applied to the mandrel in the balancing chamber. In the preferred embodiment the balancing system is further comprised of a balancing piston which is associated with the mandrel and positioned in the mandrel chamber such that the balancing chamber is divided into a balanced side and an unbalanced side.

The balancing piston is associated with the mandrel such that forces acting directly on the piston are also acting indirectly on the mandrel. The balancing force is then preferably applied to the balancing piston and thus indirectly to the mandrel from the balanced side of the balancing chamber. The balancing piston may be associated with the mandrel in any manner which permits the balancing force to be transferred to the mandrel from the balancing piston. The balancing piston is preferably fixedly mounted on the mandrel but may also be capable of some amount of axial or rotational movement relative to the mandrel as long as the balancing force can effectively be transferred to the mandrel.

Preferably the balancing chamber is provided with a biasing device such as a spring system or a compressible fluid for applying the balancing force to the balancing piston or is provided with a mechanism for transmitting a fluid pressure to the balancing piston in order to apply the balancing force to the balancing piston.

Preferably the balancing system is further comprised of a first balancing port communicating with the balanced side of the balancing chamber for transmitting a first balancing pressure to the balanced side of the balancing chamber such that the balancing force is provided by the first balancing pressure. The first balancing port may be associated with the mandrel, with the housing, or with both the mandrel and the housing. The first balancing port preferably communicates between the balanced side of the balancing chamber and a relatively high pressure space so that the balanced side of the balancing chamber is balanced to the pressure of this high pressure space.

Preferably the first balancing pressure is provided by the fluid either as it passes through the mandrel or the inner conduit or after it has been released from the inner conduit into the outer conduit. In the preferred embodiment the first balancing port communicates between the balanced side of the balancing chamber and the mandrel passage so that the first balancing pressure is provided by a mandrel passage pressure exerted by the fluid in the mandrel passage.

The first balancing port may be comprised of any device or combination of devices which are capable of transmitting the first balancing pressure to the balanced side of the balancing chamber. For example, the first balancing port may be comprised of one or more diaphragms for transmitting the first balancing pressure to a balancing fluid contained in the balanced side of the balancing chamber, or the first balancing port may be comprised of one or more vents or apertures for permitting the fluid in the mandrel passage, the inner conduit or the outer conduit to enter the balanced side of the balancing chamber. The vents or apertures may further include a filtering mechanism such as a screen for inhibiting the influx of debris into the balancing chamber.

The bushing may be designed for passage of the fluid from the first mandrel end to the second mandrel end or vice versa. The axial mandrel force may be applied to the first mandrel end, to the second mandrel end, or to both the first mandrel end and the second mandrel end.

The bushing is preferably designed so that a net balancing force will oppose a net axial mandrel force that is applied to the mandrel. As a result, the balancing system is preferably designed and the bushing is preferably configured to take into account all of the forces that may act on the mandrel during use of the bushing.

In the preferred embodiment, the bushing is intended for use in situations where the fluid is passed under pressure through the mandrel passage and is subsequently released from the inner conduit into communication with the outer conduit. In such circumstances, an axial mandrel force will act on the effective cross-sectional area of one end of the mandrel via the inner conduit due to the fluid pressure and will tend to cause the mandrel to move relative to the housing in a direction away from that end of the mandrel. The balancing system may in such circumstances be designed to oppose this axial mandrel force by applying a balancing force to the mandrel in the opposite direction.

In the preferred embodiment, the bushing is designed so that the fluid is intended to be passed from the first mandrel end to the second mandrel end and the desired direction of the balancing force is achieved by configuring the bushing so that the unbalanced side of the balancing chamber is located axially between the balanced side of the balancing chamber and the second mandrel end.

In the preferred embodiment, it may be conveniently assumed that the mandrel passage pressure which is transmitted to the balanced side of the balancing chamber is approximately equal to the fluid pressure acting on the second end of the mandrel. In the preferred embodiment, it may also be conveniently assumed that the cross-sectional area of the second mandrel end accurately represents the area upon which the axial mandrel force is acting. This second assumption may not be valid if there is a relative constriction or expansion of the mandrel at the second mandrel end, in which case an "effective cross-sectional area" of the second mandrel end may be utilized which does accurately represent the area upon which the axial mandrel force is acting.

As a result, and assuming that the only significant axial forces acting on the mandrel are the axial mandrel force due to the pressure of the fluid and the balancing force, then the balancing system can in the preferred embodiment be conveniently designed so that the cross-sectional area of the balancing piston on the balanced side of the balancing chamber is greater than or equal to the effective crosssectional area of the second mandrel end.

More sophisticated design of the balancing chamber in the preferred embodiment may take into account pressure drop experienced by the fluid as it passes from the mandrel passage to the outer conduit, irregularities in the cross-sectional area of the mandrel, and forces exerted on the mandrel in opposition to the balancing force from the unbalanced side of the balancing chamber. These factors can be taken into account in the preferred embodiment by providing that the cross-sectional area of the balancing piston on the balanced side of the balancing chamber is greater than the effective cross-sectional area of the second mandrel end by some amount as determined by either calculation or by estimate.

Preferably the magnitude of the force applied to the mandrel from the unbalanced side of the balancing chamber in opposition to the balancing force is reduced by providing the bushing with a second balancing port which communicates with the unbalanced side of the balancing chamber to minimize pressure increase in the unbalanced side due to movement of the mandrel. This second balancing port preferably communicates between the unbalanced side of the balancing chamber and a relatively low pressure space so that the unbalanced side of the balancing chamber is balanced to the pressure of this low pressure space.

In the preferred embodiment, the low pressure space is comprised of a portion of the the outer conduit which is isolated by the sealing device from the fluid pressure at the second mandrel end of the bushing, thus isolating the fluid pressure in the outer conduit from an outer conduit pressure in the outer conduit. As a result, in the preferred embodiment the second balancing port communicates between the unbalanced side of the balancing chamber and the outer conduit in order to transmit the outer conduit pressure to the unbalanced side of the balancing chamber.

Consequently, in the preferred embodiment the cross-sectional area of the balancing piston on the balanced side of the balancing chamber is selected so that the mandrel passage pressure multiplied by the cross-sectional area of the balancing piston on the balanced side is greater than or equal to the sum of the mandrel passage pressure multiplied by the effective cross-sectional area of the second mandrel end and the outer conduit pressure multiplied by the cross-sectional area of the balancing piston on the unbalanced side of the balancing chamber.

The function of the anchoring device is to prevent the bushing from being moved axially relative to the outer conduit by axial forces applied to the bushing. Such axial forces may be applied to the bushing from many sources. First, the pressure of the fluid passing through the inner conduit may exert an axial force tending to move the bushing in the same direction as the direction of travel of the fluid. Second, the fluid pressure of the fluid which is released from the inner conduit into communication with the outer conduit will exert a force on the bushing tending to move the bushing in a direction away from the fluid. Third, the outer conduit pressure will exert a force on the bushing tending to move the bushing in a direction toward the fluid. The anchoring device is preferably designed to restrain the bushing against the net maximum force which may be expected to act on the bushing.

Preferably the bushing provides for a predetermined amount of relative axial movement between the housing and the mandrel to facilitate axial manipulation of the inner conduit within the outer conduit. This axial manipulation is useful during setting of the outer conduit in the borehole, during cementing operations, and in the preferred embodiment facilitates release of the anchoring device. By providing for a predetermined amount of relative axial movement, more certainty can be obtained in assessing remotely whether the bushing is anchored within the outer conduit or is released from the outer conduit.

This predetermined amount of relative axial movement may be provided by using any apparatus, structure or device. For example, shoulders or stops may be provided on the housing and/or the mandrel.

Preferably the permitted amount of relative axial movement is defined by the balancing chamber and the balancing piston. More preferably the balancing chamber has a first balancing chamber end and a second balancing chamber end and the balancing piston is capable of axial movement within the balancing chamber substantially between the first balancing chamber end and the second balancing chamber end. In the preferred embodiment the balancing piston is fixedly connected with the mandrel so that the mandrel moves axially with the balancing piston relative to the housing to provide the relative axial movement between the housing and the mandrel as the balancing piston moves between the first balancing chamber end and the second balancing chamber end.

BRIEF DESCRIPTION OF DRAWINGS

Embodiments of the invention will now be described with reference to the accompanying drawings, in which.

DETAILED DESCRIPTION

Figure 2:
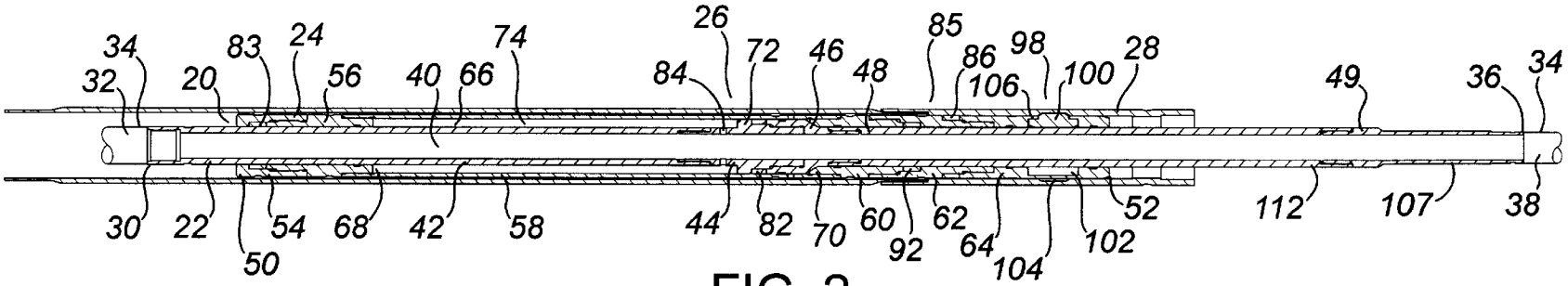
FIG. 2 is a further longitudinal sectional view of the pack-off bushing of FIG. 1, depicting the balancing piston at a position adjacent to the second balancing chamber end.
Figure 1:
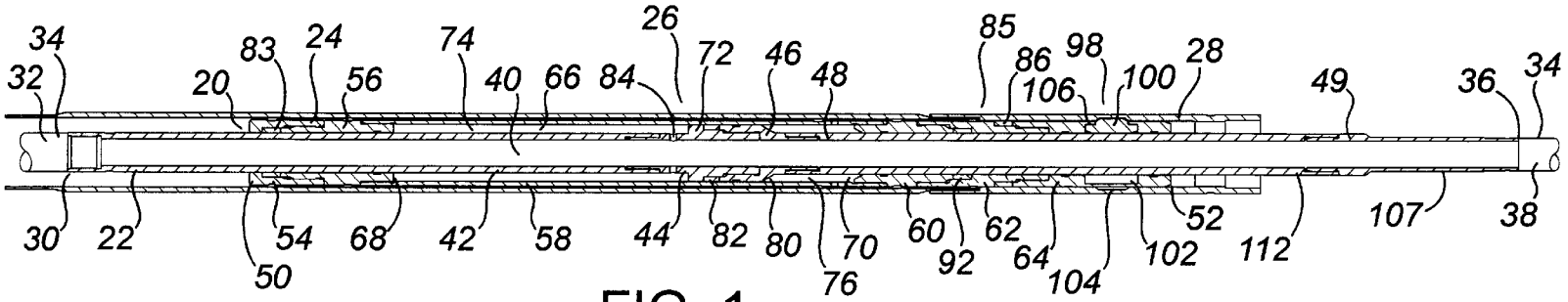
FIG. 1 is a longitudinal sectional view of a preferred embodiment of a pack-off bushing positioned within an outer conduit depicting the balancing piston at a position intermediate between the first balancing chamber end and the second balancing chamber end.
Figure 3A:
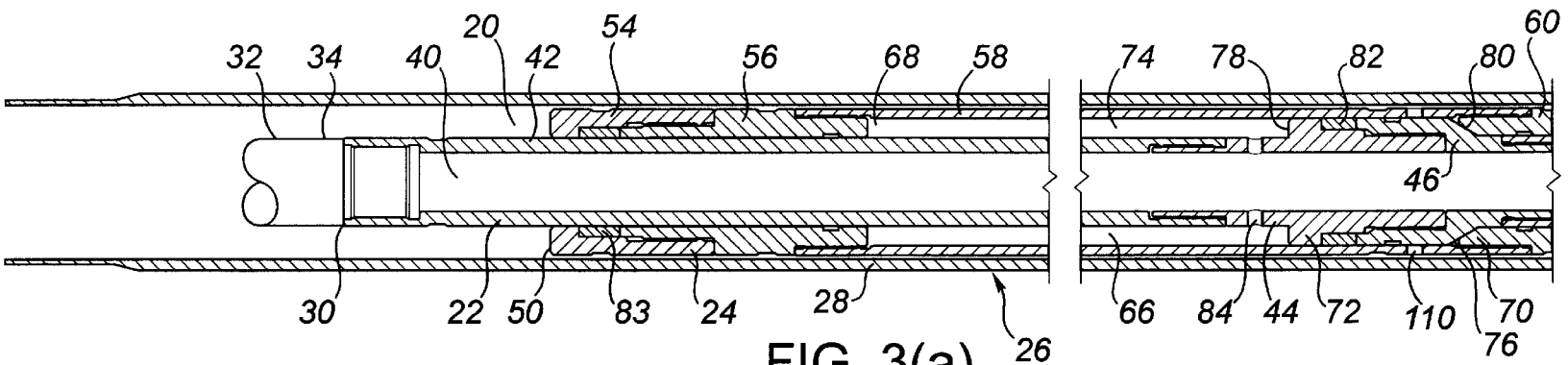
FIG. 3(*a*) and FIG. 3(*b*) are more detailed longitudinal sectional views of the pack-off bushing of FIG. 1 depicting the balancing piston at a position adjacent to the second balancing chamber end, wherein FIG. 3(*b*) is a lower continuation of FIG. 3(*a*).
Figure 3B:
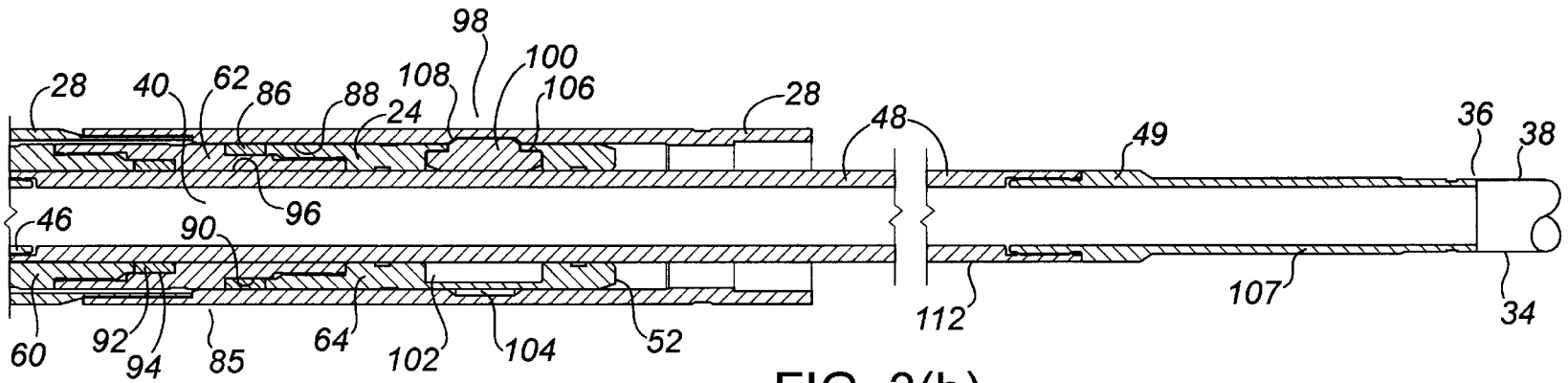

Referring to FIGS. 1 through 3, the invention is comprised of a pack-off bushing (20). The bushing (20) is comprised of a mandrel (22) and a housing (24). A balancing system (26) is associated with the mandrel (22) and the housing (24). The function of the balancing system (26) is to apply a balancing force to the mandrel (22) to oppose an axial mandrel force applied to the mandrel (22). In each of FIGS. 1, 2 and 3 the bushing (20) is shown in position inside an outer conduit (28). The outer conduit (28) may be a liner, a casing or some other conduit.

The mandrel (22) has a first mandrel end (30) for connection with a first section (32) of an inner conduit (34) and has a second mandrel end (36) for connection in the preferred embodiment with a second section (38) of the inner conduit (34). These connections may be made in any manner. For example, the sections (32,38) of the inner conduit (34) may be formed integrally with the mandrel (22) or may be threadably connected with the mandrel (22).

The mandrel (22) also defines a mandrel passage (40) which extends axially through the mandrel (22) from the first mandrel end (30) to the second mandrel end (36). The purpose of the mandrel passage (40) is to conduct fluids between the first section (32) and the second section (38) of the inner conduit (34).

The mandrel (22) may be constructed in a single piece or in more than one piece and the pieces may be connected together in any manner. In the preferred embodiment the mandrel (22) is comprised of an upper mandrel extension (42), an upper mandrel (44), a lower mandrel (46), a lower mandrel extension (48) and a lower mandrel end (49) which are all connected together end to end with threaded connections.

The housing (24) is carried on the mandrel (22) between the first mandrel end (30) and the second mandrel end (36). The housing (24) has a first housing end (50) and a second housing end (52). In the preferred embodiment the mandrel (22) and the housing (24) are capable of an amount of relative axial movement. As a result, the first mandrel end (30) extends past the first housing end (50) by at least an amount sufficient to facilitate this relative axial movement. The second mandrel end (36) extends past the second housing end (52) for the same reason. In the preferred embodiment the mandrel (22) and the housing (24) are also capable of relative rotational movement.

The housing (24) may also be constructed in a single piece or in more than one piece and the pieces may be connected together in any manner. In the preferred embodiment the housing (24) is comprised of an upper seal cap (54), an upper seal carrier (56), a housing sleeve (58), a housing coupler (60), a lower seal carrier (62) and a key carrier (64) which are all connected together end to end with threaded connections.

In the preferred embodiment the balancing system (26) is comprised of a balancing chamber (66), which balancing chamber (66) is comprised of an annular space between the mandrel (22) and the housing sleeve (58). The balancing chamber (66) has a first balancing chamber end (68) defined by the upper seal carrier (56) and a second balancing chamber end (70) defined by the housing coupler (60).

The balancing system (26) is in the preferred embodiment further comprised of a balancing piston (72) which is associated with the mandrel (22) and is positioned in the balancing chamber (66), dividing the balancing chamber (66) into a balanced side (74) and an unbalanced side (76). The function of the balancing piston (72) is to receive the balancing force and transfer the balancing force to the mandrel (22).

In the preferred embodiment the balancing piston (72) is integrally formed on the upper mandrel (44). The balancing piston (72) may, however, be associated with the mandrel (22) in any manner so long as the balancing piston (72) is capable of transferring all or a portion of the balancing force to the mandrel (22). For example, the balancing piston (72) may provide for some amount of relative axial or rotational movement between the balancing piston (72) and the mandrel (22).

The balancing piston (72) has a cross-sectional area (78) on the balanced side (74) of the balancing chamber (66) and a cross-sectional area (80) on the unbalanced side (76) of the balancing chamber (66). In the preferred embodiment the cross-sectional area (78) is greater than the cross-sectional area (80), but the dimensions of the balancing piston (72) will in the practice of the invention depend upon the design requirements for the bushing (20).

The balanced side (74) of the balancing chamber (66) is in the preferred embodiment isolated from the unbalanced side (76) of the balancing chamber (66) by a piston seal (82) between an outer surface of the balancing piston (72) and an inner surface of the housing sleeve (58). If, however, the balancing force is provided by other than a fluid in the balancing chamber (66), it may not be necessary to isolate the balanced side (74) from the unbalanced side (78).

In the preferred embodiment, the function of the upper seal cap (54) is to protect the upper seal carrier (56) and hold it in position. In the preferred embodiment, the function of the upper seal carrier (56) is to provide an upper seal (83) between the mandrel (22) and the housing (24) and to isolate the balanced side (74) of the balancing chamber (66) from the outer conduit (28). If, however, the balancing force is provided by other than a fluid in the balancing chamber (66), it may not be necessary to isolate the balanced side (74) from the outer conduit (28).

In the preferred embodiment the balanced side (74) of the balancing chamber (66) is therefore isolated from the unbalanced side (76) of the balancing chamber (66) and from the outer conduit (28) and is of variable length depending upon the position of the balancing piston (72) in the balancing chamber (66).

In the preferred embodiment the balancing system (26) is further comprised of a first balancing port (84) which communicates with the balanced side (74) of the balancing chamber (66) in order to transmit a first balancing pressure to the balanced side (74) of the balancing chamber (66). This first balancing pressure is in the preferred embodiment exerted by the fluid which is passed through the inner conduit (34), with the result that the balancing force is provided by pressure exerted by the fluid.

The first balancing port (84) may communicate with the balanced side (74) of the balancing chamber (66) from any location which is exposed to the fluid which is passed through the inner conduit (34). In the preferred embodiment the first balancing port (84) communicates between the balanced side (74) of the balancing chamber (66) and the mandrel passage (40) and is comprised of a plurality of vent holes spaced circumferentially around the upper mandrel (44), with the result that the first balancing pressure is provided by a mandrel passage pressure.

Alternatively, the balancing system (26) may provide the balancing force by other than fluid pressure exerted by the fluid which is passed through the inner conduit (34). For example, the balanced side (74) of the balancing chamber (66) may be provided with a biasing device such as a spring or a compressible fluid or may communicate with a fluid other than the fluid which is passed through the inner conduit (34).

The function of the housing coupler (60) is to join the housing sleeve (58) with the lower seal carrier (62). The function of the lower seal carrier (62) is to provide a sealing device between the outer conduit (28) and the inner conduit (34).

In the preferred embodiment the lower seal carrier (62) includes a sealing device (85) comprising an outer seal assembly (86) for sealing between an internal outer conduit surface (88) on the outer conduit (28) and an outer housing surface (90) on the housing (24), and comprising an inner seal assembly (92) for sealing between an inner housing surface (94) on the housing (24) and an outer mandrel surface (96) on the mandrel (22). Other configurations of sealing device (85) may be utilized.

The function of the key carrier (64) is to provide an anchoring device (98) for anchoring the bushing (20) in the outer conduit (28). In the preferred embodiment the anchoring device (98) is comprised of a plurality of keys (100) which are mounted in recesses (102) in the key carrier (64) such that the keys (100) are capable of engaging complementary latches (104) which are formed in the internal outer conduit surface (88). Lugs (106) on the keys (100) prevent the keys (100) from falling out of the key carrier (64). In the preferred embodiment the complementary latches (104) are comprised of a circumferential groove formed in the internal outer conduit surface (88).

In the preferred embodiment the keys (100) are mounted in the recesses (102) so that they may extend to engage the latches (104) and retract to disengage from the latches (104), thus providing a releasable anchoring device (98). Preferably the keys (100) are alternately extended and retracted by axial movement of the mandrel (22) and resulting engagement of the keys (100) with sections of the mandrel (22) having different radial dimensions.

In the preferred embodiment the keys (100) are extended by abutment with the outer mandrel surface (96) as shown in FIGS. 1–3, but may be retracted by axial movement of the mandrel (22) which causes a constriction (107) on the lower mandrel end (49) to be moved into position adjacent to the keys (100) in order to provide clearance for the keys (100) to retract from the circumferential groove which comprises the latches (104). The keys (100) are provided with sloped shoulders (108) to assist in disengagement of the bushing (24) from the outer conduit (28) once the keys (100) are retracted.

Alternatively, the keys (100) may be designed to be retracted from the latches (104) by rotation of the bushing (20) in which case the keys (100) are preferably provided with sloped sides (not shown). The anchoring device (98) may also be designed so that the keys (100) "float" in the recesses (102) and are retracted by the application of an axial releasing force to the mandrel (22), in which case the keys (100) are preferably biased outwards by springs or some other biasing device. The anchoring device (98) may also utilize some structure, apparatus or device other than keys (100) and latches (104).

In the preferred embodiment the unbalanced side (76) of the balancing chamber (66) is isolated from the balanced side (74) of the balancing chamber (66) by the piston seal (82) and the unbalanced side (76) of the balancing chamber (66) is isolated from the outer conduit by the lower seal carrier (62). The unbalanced side (76) of the balancing chamber (66) is of variable length depending upon the position of the balancing piston (72) in the balancing chamber (66).

In the preferred embodiment the bushing (20) is further comprised of a second balancing port (110) which communicates with the unbalanced side (76) of the balancing chamber (66) for transmitting a second balancing pressure to the unbalanced side (76) of the balancing chamber (66). The purpose of the second balancing port (110) is to provide a fluid inlet and a fluid outlet in the unbalanced side (76) of the balancing chamber (66) so that the pressure in the unbalanced side (76) is equalized to the second balancing pressure for all positions of the balancing piston (72) in the balancing chamber (66).

In the preferred embodiment the bushing (20) is designed so that cement or other bonding fluid is passed through the mandrel passage (40) during cementing operations from the first mandrel end (30) to the second mandrel end (36) and from the first housing end (50) to the second housing end (52). The axial mandrel force is therefore exerted by the fluid o n the second mandrel end (36), a force is exerted by the fluid on the second housing end (52), and the balancing force acts in the opposite direction as the axial mandrel force.

As a result, in the preferred embodiment the bushing (20) is configured so that the unbalanced side (76) of the balancing chamber (66) is located axially between the balanced side (74) of the balancing chamber (66) and the second mandrel end (36) and so that the unbalanced side (76) of the balancing chamber (66) is located axially between the balanced side (74) of the balancing chamber (66) and the second housing end (52).

Since the balancing force must oppose the axial mandrel force, the first balancing pressure in the preferred embodiment is greater than the second balancing pressure. Additionally, in the preferred embodiment the cross-sectional area (78) of the balancing piston (72) on the balanced side (74) of the balancing chamber (66) is greater than the cross-sectional area (80) of the balancing piston (72) on the unbalanced side (76) of the balancing chamber (66), thus ensuring that the balancing force is greater than forces exerted on the mandrel (22) from the unbalanced side (76) of the balancing chamber (66). Any combination of first balancing pressure, second balancing pressure and cross-sectional areas (78,80) which accomplishes this objective may be utilized in the design of the bushing (20).

As previously indicated, the first balancing pressure in the preferred embodiment is provided by fluid pressure from the fluid which is passed through the inner conduit (34), which pressure is in the preferred embodiment relatively high. In the preferred embodiment the second balancing pressure is provided by an outer conduit pressure which is relatively low and which is isolated by the sealing device (85) from fluid pressure exerted by the fluid which is passed through the inner conduit (34).

The sealing device (85) is therefore in the preferred embodiment located axially between the second balancing port (110) and the second housing end (52) in order to provide the necessary isolation, and the second balancing port (110) in the preferred embodiment is comprised of a plurality of vent holes in the housing sleeve (58) which facilitate communication between the unbalanced side (76) of the balancing chamber (66) and the outer conduit (28).

The principles of the invention may be applied to a wide range of specific designs for the bushing (20). In particular the forces which are exerted on the bushing (20) by the fluid pressure, the outer conduit pressure, the first balancing pressure and the second balancing pressure may be controlled with the invention by selecting the cross-sectional areas (78,80) of the balancing piston (72) and the cross-sectional areas of the first mandrel end (30), the second mandrel end (36) the first housing end (50) and the second housing end (52).

In the preferred embodiment the net force on the mandrel (22) which is provided by the balanced side (74) of the balancing chamber (66) and the unbalanced side (76) of the balancing chamber (66) is designed to be greater than or equal to the axial mandrel force exerted on the mandrel (22) by the fluid which is passed through the inner conduit (34).

As a result, in the preferred embodiment the cross-sectional area (78) of the balancing piston (72) on the balanced side (74) of the balancing chamber (66) may be selected to be greater than or equal to an effective cross-sectional area (112) of the second mandrel end (36) on the assumption that the mandrel passage pressure is approximately equal to the fluid pressure exerted on the second mandrel end (36) and on the assumption that the force exerted by the second balancing pressure is negligible. More preferably, the cross-sectional areas (78,80) of the balancing piston (72) and the effective cross-sectional area (112) of the second mandrel end (36) are selected to account for the potential inaccuracy of these assumptions.

In the preferred embodiment the housing (24) and the mandrel (22) are capable of an amount of relative axial movement so that the inner conduit (34) may be manipulated axially during hanging of the outer conduit (28), during cementing operations and in order to release the anchoring device (98). In the preferred embodiment the housing (24) and the mandrel (22) are also capable of an amount of relative rotational movement so that the inner conduit (34) may be manipulated rotationally during hanging of the outer conduit (28) and during cementing operations.

The amount of relative axial movement which is permitted between the housing (24) and the mandrel (22) may be limited by providing stops, shoulders or lugs on either or both of the housing (24) and the mandrel (22). In the preferred embodiment the permitted amount of relative axial movement is defined by the length of the balancing chamber (66).

In particular, in the preferred embodiment the balancing piston (72) is capable of movement in the balancing chamber (66) between the lower seal carrier (62) and the housing coupler (60).

As a result, in the preferred embodiment where the balancing piston (72) is integrally formed with the upper mandrel (44), the amount of permitted relative axial movement between the housing (24) and the mandrel (22) is defined by the distance travelled by the balancing piston (72) between a position where it abuts the lower seal carrier (62) and a position where the lower mandrel (46) abuts the housing coupler (60), since the mandrel (22) will move axially with the balancing piston (72).

The bushing (20) may be used in any situation where a fluid is intended to be passed through an inner conduit (34) which is positioned within an outer conduit (28), particularly where it is desirable to isolate a portion of the outer conduit (28) on one side of the bushing (20) from a portion of the outer conduit (28) on a second side of the bushing (20). In the preferred embodiment the bushing (20) is used in conjunction with cementing operations in a borehole and most preferably is used in conjunction with a liner hanging apparatus (not shown) which facilitates hanging of the outer conduit (28) and cementing of the outer conduit (28) in the borehole during a single trip into the borehole.

In preparation for use of the bushing (20) the first mandrel end (30) is connected with the first section (32) of the inner conduit (34), which inner conduit (34) is included as part of a liner hanging apparatus. The inner conduit (34) may terminate at the first mandrel end (30) but in the preferred embodiment the second section (38) of the inner conduit (34) is connected with the second mandrel end (36) so that the mandrel (22) is connected between the first section (32) of the inner conduit (34) and the second section (38) of the inner conduit (38). The outer conduit (28) is also releasably connected with the liner hanging apparatus with the mandrel (22) positioned such that the keys (100) on the bushing (20) are extended into the circumferential groove (104) on the outer conduit (28). The liner hanging apparatus and the outer conduit (28) are then lowered into a borehole to a desired depth for hanging of the outer conduit (28).

The outer conduit (28) is then hung in position in the borehole using a liner hanging device and method such as those known in the prior art, following which the outer conduit (28) is released from the liner hanging apparatus so that manipulation of the inner conduit (34) will not result in movement of the outer conduit (28). The bushing (20), however, remains anchored to the outer conduit (28) with the anchoring device (98).

Confirmation of the release of the outer conduit (28) from the liner hanging apparatus can be obtained by "stroking" the inner conduit (34) through a portion of its range of relative axial movement, stopping short of positioning the constriction (107) on the lower mandrel end (49) adjacent to the keys (100). Once release of the outer conduit (28) from the liner hanging apparatus has been confirmed, cementing operations in the borehole can be carried out.

Cementing operations are carried out in the borehole by first passing a flushing fluid through the inner conduit (34). After the outer conduit (28) and the annular space between the outer conduit (28) and the borehole have been flushed to eliminate debris, cement or some other bonding fluid can be passed through the inner conduit (34). The bonding fluid passes through the mandrel passage (40), exits the inner conduit (34) below the bushing (20) and then moves into the annular space between the outer conduit (28) and the borehole as well as up the outer conduit (28) to the location of the bushing (20).

The inner conduit (34) and the mandrel (22) are maintained in axial position in the outer conduit (28) by operation of the balancing system (26). The bushing (20) is maintained in axial position in the outer conduit (28) by the anchoring device (98).

Once cementing operations are completed, the liner hanging apparatus, including the inner conduit (34) and the bushing (20) may be removed from the outer conduit (28) and the borehole by stroking the inner conduit (34) through its entire range of relative axial movement, which causes the constriction (107) on the lower mandrel end (49) to be positioned adjacent to the keys (100) and permits the keys (100) to retract from the latches (104) to release the anchoring device (98).

The balancing feature of the invention permits cementing operations to be conducted after the release of the outer conduit (28) from the liner hanging apparatus by ensuring that the anchoring device (98) is not accidentally or prematurely released during cementing operations due to unwanted axial movement of the inner conduit (34) caused by fluid pressure exerted on the inner conduit (34). In other words, the inner conduit (34) remains "locked" to the outer conduit (28) during cementing operations but can be mechanically disconnected from the outer conduit (28) by intentional relative axial movement between the outer conduit (28) and the outer conduit (34) after cementing operations are completed.

The embodiments of the invention in which an exclusive property or privilege is claimed are defined as follows:

1. A pack-off bushing for placement inside an outer conduit while a fluid is passed through an inner conduit positioned within the outer conduit, the bushing comprising:

(a) a mandrel for connection with the inner conduit, the mandrel having a first mandrel end, a second mandrel end, and defining a mandrel passage axially therethrough for conducting the fluid through the mandrel;

(b) a housing carried on the mandrel between the first mandrel end and the second mandrel end, wherein the housing and the mandrel are capable of an amount of relative axial movement;

(c) a balancing system associated with the mandrel and the housing for applying a balancing force to the mandrel to oppose an axial mandrel force applied to the mandrel; and (d) a sealing device for providing a seal between the outer conduit and the inner conduit.

2. The bushing as claimed in claim 1 wherein the outer conduit is comprised of an internal outer conduit surface, wherein the housing is comprised of an outer housing surface and wherein the sealing device is comprised of an outer seal assembly for scaling between the internal outer conduit surface and the outer housing surface.

3. The bushing as claimed in claim 2 wherein the housing is comprised of an inner housing surface, wherein the mandrel is comprised of an outer mandrel surface and wherein the scaling device is further comprised of an inner seal assembly for scaling between the inner housing surface and the outer mandrel surface.

4. The bushing as claimed in claim 1, further comprising an anchoring device for anchoring the bushing in the outer conduit.

5. The bushing as claimed in claim 4 wherein the anchoring device is a releasable anchoring device to facilitate removal of the bushing from the outer conduit.

6. The bushing as claimed in claim 5 wherein the releasable anchoring device is released by relative axial movement between the housing and the mandrel.

7. The bushing as claimed in claim 6 wherein the releasable anchoring device is comprised of at least one key on the housing for engagement with at least one latch on the internal outer conduit surface.

8. The pack-off bushing as claimed in claim 1 wherein the balancing system is comprised of a balancing chamber defined between the housing and the mandrel and wherein the balancing force is applied to the mandrel in the balancing chamber.

9. The pack-off bushing as claimed in claim 8 wherein the balancing system is further comprised of a balancing piston associated with the mandrel and positioned in the balancing chamber such that the balancing chamber is divided into a balanced side and an unbalanced side, and wherein the balancing force is applied to the balancing piston from the balanced side of the balancing chamber.

10. The pack-off bushing as claimed in claim 9 wherein the balancing system is further comprised of a first balancing port communicating with the balanced side of the balancing chamber for transmitting a first balancing pressure to the balanced side of the balancing chamber such that the balancing force is provided by the first balancing pressure.

11. The pack-off bushing as claimed in claim 10 wherein the first balancing port communicates between the balanced side of the balancing chamber and the mandrel passage and wherein the first balancing pressure is provided by a mandrel passage pressure.

12. The bushing as claimed in claim 11 further comprising an anchoring device for anchoring the bushing in the outer conduit.

13. The bushing as claimed in claim 12 wherein the anchoring device is a releasable anchoring device to facilitate removal of the bushing from the outer conduit.

14. The bushing as claimed in claim 13 wherein the releasable anchoring device is comprised of at least one key on the housing for engagement with at least one latch on the internal outer conduit surface.

15. The bushing as claimed in claim 13 wherein the releasable anchoring device is released by relative axial movement between the housing and the mandrel.

16. The bushing as claimed in claim 15 wherein the releasable anchoring device is comprised of at least one key on the housing for engagement with at least one latch on the internal outer conduit surface.

17. The bushing as claimed in claim 13 wherein the unbalanced side of the balancing chamber is located axially between the balanced side of the balancing chamber and the second mandrel end.

18. The bushing as claimed in claim 17 wherein the balancing piston has a crosssectional area on the balanced side of the balancing chamber, wherein the second mandrel end has an effective cross-sectional area and wherein the cross-sectional area of the balancing piston on the balanced side of the balancing chamber is greater than or equal to the effective crosssectional area of the second mandrel end.

19. The bushing as claimed in claim 17 further comprising a second balancing port communicating with the unbalanced side of the balancing chamber for transmitting a second balancing pressure to the unbalanced side of the balancing chamber.

20. The bushing as claimed in claim 19 wherein the sealing device is adapted to isolate a fluid pressure in the outer conduit from an outer conduit pressure in the outer conduit and wherein the second balancing pressure is provided by the outer conduit pressure.

21. The bushing as claimed in claim 20 wherein the balancing piston has a crosssectional area on the balanced side of the balancing chamber, wherein the balancing piston has a cross-sectional area on the unbalanced side of the balancing chamber, wherein the second mandrel end has an effective cross-sectional area and wherein the cross-sectional area of the balancing piston on the balanced side of the balancing chamber is selected so that the mandrel passage pressure multiplied by the cross-sectional area of the balancing piston on the balanced side is greater than or equal to the sum of the mandrel passage pressure multiplied by the effective cross-sectional area of the second mandrel end and the outer conduit pressure multiplied by the cross-sectional area of the balancing piston on the unbalanced side of the balancing chamber.

22. The bushing as claimed in claim 15 wherein the housing is comprised of a first housing end and a second housing end and wherein the unbalanced side of the balancing chamber is located axially between the balanced side of the balancing chamber and the second housing end.

23. The bushing as claimed in claim 9 wherein the balancing chamber has a first balancing chamber end and a second balancing chamber end and wherein the balancing piston is capable of axial movement within the balancing chamber substantially between the first balancing chamber end and the second balancing chamber end.

24. The bushing as claimed in claim 23 wherein the balancing piston is fixedly connected with the mandrel so that the mandrel moves axially with the balancing piston relative to the housing in order to provide the relative axial movement between the housing and the mandrel as the balancing piston moves between the first balancing chamber end and the second balancing chamber end.

* * * * *